US010971083B2

(12) United States Patent
Meng et al.

(10) Patent No.: US 10,971,083 B2
(45) Date of Patent: Apr. 6, 2021

(54) COMPENSATION METHOD AND COMPENSATION APPARATUS FOR DISPLAY PANEL, AND DISPLAY DEVICE

(71) Applicant: BOE TECHNOLOGY GROUP CO., LTD., Beijing (CN)

(72) Inventors: Song Meng, Beijing (CN); Fei Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/620,989

(22) PCT Filed: Feb. 12, 2018

(86) PCT No.: PCT/CN2018/076388
§ 371 (c)(1),
(2) Date: Dec. 10, 2019

(87) PCT Pub. No.: WO2019/000970
PCT Pub. Date: Jan. 3, 2019

(65) Prior Publication Data

US 2020/0202792 A1 Jun. 25, 2020

(30) Foreign Application Priority Data

Jun. 30, 2017 (CN) ..... 201710526389.7

(51) Int. Cl.
*G09G 3/32* (2016.01)
*G09G 3/3291* (2016.01)

(52) U.S. Cl.
CPC ..... *G09G 3/3291* (2013.01); *G09G 2310/027* (2013.01); *G09G 2320/045* (2013.01); *G09G 2320/0626* (2013.01)

(58) Field of Classification Search
CPC ..... G09G 3/3291; G09G 2310/027; G09G 2320/045; G09G 2320/0626;
(Continued)

(56) References Cited

U.S. PATENT DOCUMENTS 9,754,536 B2 9/2017 Chang et al.
9,865,198 B2 1/2018 Tsuji
(Continued)

FOREIGN PATENT DOCUMENTS

CN 101939776 A 1/2011
CN 104809986 A 7/2015
(Continued)

OTHER PUBLICATIONS

International Search Report of PCT/CN2018/076388 in Chinese, dated May 9, 2018, with English translation.
(Continued)

*Primary Examiner* — Lunyi Lao
*Assistant Examiner* — Jarurat Suteerawongsa
(74) *Attorney, Agent, or Firm* — Collard & Roe, P.C.

(57) ABSTRACT

A compensation method for a display panel, a compensation device for a display panel, and a display apparatus are provided. The display panel includes a plurality of pixel units, and each pixel unit includes a pixel circuit and a light-emitting element. The compensation method includes: detecting a threshold voltage of a drive transistor in the pixel circuit; detecting a maximum data voltage corresponding to a maximum brightness of the light-emitting element; and based on the threshold voltage, the maximum data voltage and an expected display brightness, calculating a compensation display data voltage in a normal display state after the display panel is compensated.

17 Claims, 5 Drawing Sheets

(58) Field of Classification Search
CPC ..... G09G 3/3233; G09G 3/32; G09G 3/3258; G09G 2320/0271
See application file for complete search history.

(56) References Cited

U.S. PATENT DOCUMENTS

| | | | | |
|---|---|---|---|---|
| 10,204,557 | B2 | 2/2019 | Song et al. | |
| 2006/0202913 | A1* | 9/2006 | Hayafuji | G09G 3/3233 345/44 |
| 2011/0032243 | A1 | 2/2011 | Tsuji | |
| 2014/0152633 | A1* | 6/2014 | Park | G09G 3/3291 345/207 |
| 2015/0379937 | A1 | 12/2015 | Kim et al. | |
| 2017/0154579 | A1* | 6/2017 | Choi | G09G 3/3233 |
| 2017/0169767 | A1 | 6/2017 | Song | |
| 2017/0193922 | A1 | 7/2017 | Pyeon | |
| 2018/0240410 | A1 | 8/2018 | Yang et al. | |
| 2018/0308422 | A1* | 10/2018 | Hwang | G09G 3/3208 |
| 2020/0082767 | A1 | 3/2020 | Chen et al. | |

FOREIGN PATENT DOCUMENTS

| | | | |
|---|---|---|---|
| CN | 105096834 | A | 11/2015 |
| CN | 105374320 | A | 3/2016 |
| CN | 106023892 | A | 10/2016 |
| CN | 106782333 | A | 5/2017 |
| CN | 106816135 | A | 6/2017 |
| CN | 106856086 | A | 6/2017 |
| CN | 106935188 | A | 7/2017 |
| KR | 10-2010-0047505 | A | 5/2010 |
| KR | 10-2017-0050745 | A | 5/2017 |

OTHER PUBLICATIONS

International Preliminary Report on Patentability of PCT/CN2018/076388, dated Dec. 31, 2019 and Written Opinion of the International Searching Authority of PCT/CN2018/076388 in Chinese, dated May 9, 2018 with English translation.
Chinese Office Action in Chinese Application No. 201710526389.7, dated Nov. 22, 2019 with English translation.
English translation of Extended European Search Report in EP Application No. 18824714.2 dated Feb. 9, 2021.

* cited by examiner

COMPENSATION METHOD AND COMPENSATION APPARATUS FOR DISPLAY PANEL, AND DISPLAY DEVICE

CROSS REFERENCE TO RELATED APPLICATIONS

This application is the National Stage of PCT/CN2018/076388 filed on Feb. 12, 2018, which claims priority under 35 U.S.C. § 119 of Chinese Application No. 201710526389.7 filed on Jun. 30, 2017, the disclosure of which is incorporated by reference.

TECHNICAL FIELD

The embodiments of the present disclosure relate to a compensation method for a display panel, a compensation device for a display panel, and a display device.

BACKGROUND

With the advancements in display technology, organic light-emitting diode (OLED) display panels are one of the focuses in the field of flat panel display research nowadays. More and more active matrix organic light-emitting diode (AMOLED) display panels enter the market. Compared with conventional thin film transistor liquid crystal display (TFT LCD) panels, AMOLED display panels have faster response speeds, higher contrast ratio, and wider viewing angles.

SUMMARY

At least one embodiment of the present disclosure provides a compensation method for a display panel, the display panel comprises a plurality of pixel units, each pixel unit comprises a pixel circuit and a light-emitting element, and the compensation method comprises: detecting a threshold voltage of a drive transistor in the pixel circuit; detecting a maximum data voltage corresponding to a maximum brightness of the light-emitting element; and based on the threshold voltage, the maximum data voltage and an expected display brightness, calculating a compensation display data voltage in a normal display state after the display panel is compensated.

For example, in the compensation method provided by an embodiment of the present disclosure, the pixel circuit comprises a sense line connected to a first electrode of the drive transistor, and the detecting the threshold voltage of the drive transistor in the pixel circuit comprises: applying a first data voltage to a data signal input end of the pixel circuit to charge the sense line; detecting a first sense voltage on the sense line in a case where the drive transistor in the pixel circuit is turned off; and calculating the threshold voltage of the drive transistor according to the first data voltage and the first sense voltage.

For example, in the compensation method provided by an embodiment of the present disclosure, the threshold voltage is obtained by a following calculation formula:

$$Vth = V\text{data}1 - Vse1$$

where Vth represents the threshold voltage of the drive transistor, Vdata1 represents the first data voltage, and Vse1 represents the first sense voltage.

For example, in the compensation method provided by an embodiment of the present disclosure, the pixel circuit comprises a sense line connected to a first electrode of the drive transistor, and the detecting the maximum data voltage corresponding to the maximum brightness of the light-emitting element comprises: applying a second data voltage to a data signal input end of the pixel circuit to charge the sense line; acquiring a second sense voltage on the sense line after charging the sense line for a preset time length; and determining that the second sense voltage is equal to a target sense voltage, and detecting the second data voltage applied to the data signal input end, wherein the second data voltage is the maximum data voltage corresponding to the maximum brightness of the light-emitting element.

For example, in the compensation method provided by an embodiment of the present disclosure, the acquiring the second sense voltage on the sense line after charging the sense line for the preset time length comprises: detecting the second sense voltage on the sense line after charging the sense line for the preset time length; comparing the second sense voltage with the target sense voltage; reducing the second data voltage applied to the data signal input end, in response to determining that the second sense voltage is greater than the target sense voltage; increasing the second data voltage applied to the data signal input end, in response to determining that the second sense voltage is smaller than the target sense voltage; and acquiring the second sense voltage on the sense line, in response to determining that the second sense voltage is equal to the target sense voltage.

For example, the compensation method provided by an embodiment of the present disclosure further comprises: performing a local lighting test on the display panel to determine the target sense voltage.

For example, in the compensation method provided by an embodiment of the present disclosure, the compensation display data voltage is calculated according to a following calculation formula:

$$Vgs = \sqrt{L}(Vgs1 - Vth) + Vth$$

where Vgs represents the compensation display data voltage, Vgs1 represents the maximum data voltage, L represents the expected display brightness, and Vth represents the threshold voltage of the drive transistor.

At least one embodiment of the present disclosure provides a compensation device for a display panel, the display panel comprises a plurality of pixel units, each pixel unit comprises a pixel circuit and a light-emitting element, and the compensation device comprises a threshold voltage detector, a maximum data voltage detector, and a processor, the threshold voltage detector is configured to detect a threshold voltage of a drive transistor in the pixel circuit; the maximum data voltage detector is configured to detect a maximum data voltage corresponding to a maximum brightness of the light-emitting element; and the processor is configured, based on the threshold voltage, the maximum data voltage, and an expected display brightness, to calculate a compensation display data voltage in a normal display state after the display panel is compensated.

For example, in the compensation device provided by an embodiment of the present disclosure, the pixel circuit comprises a sense line connected to a first electrode of the drive transistor, and the threshold voltage detector is configured to: apply a first data voltage to a data signal input end of the pixel circuit to charge the sense line, and detect a first sense voltage on the sense line in a case where the drive transistor in the pixel circuit is turned off; and calculate to obtain the threshold voltage of the drive transistor according to the first data voltage and the first sense voltage.

For example, in the compensation device provided by an embodiment of the present disclosure, the threshold voltage is obtained by a following calculation formula:

$$Vth = V\text{data}1 - Vse1$$

where Vth represents the threshold voltage of the drive transistor, Vdata1 represents the first data voltage, and Vse1 represents the first sense voltage.

For example, in the compensation device provided by an embodiment of the present disclosure, the pixel circuit comprises a sense line connected to a first electrode of the drive transistor, and the maximum data voltage detector is configured to: apply a second data voltage to a data signal input end of the pixel circuit to charge the sense line; acquire a second sense voltage on the sense line after charging the sense line for a preset time; and determine that the second sense voltage is equal to a target sense voltage, and detect the second data voltage applied to the data signal input end, in which the second data voltage is the maximum data voltage corresponding to the maximum brightness of the light-emitting element.

For example, in the compensation device provided by an embodiment of the present disclosure, an operation of acquiring the second sense voltage on the sense line after charging the sense line for the preset time length comprises: detecting the second sense voltage on the sense line after charging the sense line for the preset time length; and comparing the second sense voltage with the target sense voltage; reducing the second data voltage applied to the data signal input end, in response to determining that the second sense voltage is greater than the target sense voltage; increasing the second data voltage applied to the data signal input end, in response to determining that the second sense voltage is smaller than the target sense voltage; and acquiring the second sense voltage on the sense line, in response to determining that the second sense voltage is equal to the target sense voltage.

For example, the compensation device provided by an embodiment of the present disclosure further comprises a lighting tester, and the lighting tester is configured to perform a local lighting test on the display panel to determine the target sense voltage.

For example, in the compensation device provided by an embodiment of the present disclosure, the compensation display data voltage is calculated according to a following calculation formula:

$$Vgs = \sqrt{L}(Vgs1 - Vth) + Vth$$

where Vgs represents the compensation display data voltage, Vgs1 represents the maximum data voltage, L represents the expected display brightness, and Vth represents the threshold voltage of the drive transistor.

For example, in the compensation device provided by an embodiment of the present disclosure, the pixel circuit further comprises a data writing transistor, a sense transistor, and a storage capacitor, the drive transistor is configured to drive the light-emitting element to emit light; the data writing transistor is configured to write a data voltage to a gate electrode of the drive transistor in a case where the data writing transistor is turned on; the storage capacitor is configured to store the data voltage and maintain the data voltage at the gate electrode of the drive transistor; and the sense transistor is configured to charge the sense line.

For example, in the compensation device provided by an embodiment of the present disclosure, a first electrode of the sense transistor is electrically connected to a first electrode of the drive transistor, a second electrode of the sense transistor is electrically connected to the sense line, and a gate electrode of the sense transistor is configured to receive a second control signal; the first electrode of the drive transistor is further electrically connected to an anode of the light-emitting element, a second electrode of the drive transistor is electrically connected to a first power terminal, and the gate electrode of the drive transistor is electrically connected to a first electrode of the data writing transistor; a gate electrode of the data writing transistor is configured to receive a first control signal, and a second electrode of the data writing transistor is configured to receive the data voltage; and a terminal of the storage capacitor is electrically connected to the first electrode of the drive transistor, and a remaining terminal of the storage capacitor is electrically connected to the gate electrode of the drive transistor.

At least one embodiment of the present disclosure provides a compensation device for a display panel, comprising: a memory, configured to store non-transitory computer readable instructions; a processor, configured to execute the non-transitory computer readable instructions, in a case where the non-transitory computer readable instructions are executed by the processor, the compensation method according to any one of the above embodiments.

At least one embodiment of the present disclosure provides a display device, comprising the compensation device according to any one of the above embodiments.

BRIEF DESCRIPTION OF THE DRAWINGS

In order to clearly illustrate the technical solutions of the embodiments of the present disclosure, the drawings of the embodiments will be briefly described in the following; it is obvious that the described drawings are only related to some embodiments of the disclosure and thus are not limitative to the disclosure.

DETAILED DESCRIPTION

Figure 1:
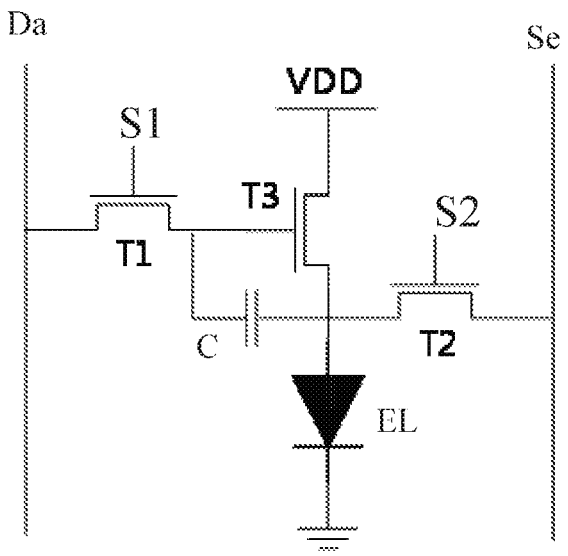
FIG. 1 is a schematic structural diagram of a pixel circuit according to an embodiment of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Currently, a pixel circuit of an AMOLED display panel mainly comprises: a drive transistor, a selection transistor, a sense transistor, and a capacitor. In the pixel circuit, a particular data voltage is applied to the pixel circuit through a data line, and a sense current flowing through the sense transistor is detected, or the charges are accumulated on the sense line and the sense voltage is detected, and then the data voltage is adjusted by calculation to achieve a compensation effect.

A particular compensation method includes: first presetting a first target voltage for a charging voltage of the sense line, applying the data voltage to the data line, charging the sense line for a particular time length, detecting a sense voltage on the sense line, and comparing the sense voltage with the preset first target voltage; if the sense voltage on the sense line is greater than the first target voltage, reducing the data voltage applied to the data line, and then performing a sensing operation again; if the sense voltage on the sense line is smaller than the first target voltage, increasing the data voltage applied to the data line, and then performing the sensing operation again. At the same time, the increased amount or the reduced amount of the data voltage of each loop is determined according to a difference between the sense voltage on the sense line and the first target voltage, and after multiple feedback loops, it is considered that the sense voltages on all sense lines of the AMOLED display panel are consistent with the first target voltage, so that the AMOLED display panel achieves full-screen uniform compensation for the brightness corresponding to the first target voltage (assuming that the first target voltage corresponds to a first data voltage in this case). Similarly, a second data voltage corresponding to a second target voltage can be obtained. A threshold voltage Vth and the value of a constant K of the drive transistor can be calculated according to the first data voltage and the second data voltage. According to a driving current formula ($I=K(Vgs-Vth)^2$) for driving the light-emitting element OLED to emit light, the full-screen and full-grayscale compensation for the AMOLED display panel is implemented.

However, the shortcomings of this compensation method lie in that the Vth and the value of K in the driving current formula are calculated by the first data voltage and the second data voltage which are measured. If there is a measurement error in any one of the first data voltage and the second data voltage, inaccurate calculation results may be obtained, thereby resulting in a poor compensation effect. Especially for Vth, inaccurate Vth will make the compensation uniformity for low grayscales poor, which likely causes very serious low grayscale loss. Therefore, improving the compensation effect of the display panel for low grayscales to improve the brightness uniformity of the display screen is an urgent technical problem to be solved by those skilled in the art.

Embodiments of the present disclosure provide a compensation method for a display panel, a compensation device for a display panel, and a display device to effectively improve the compensation effect of the display panel for low grayscales, reduce or eliminate a low grayscale loss phenomenon, and improve the compensation effect.

The compensation method for the display panel, the compensation device for the display panel, and the display device provided by the embodiments of the present disclosure are described in detail below with reference to the accompanying drawings.

Figure 2:
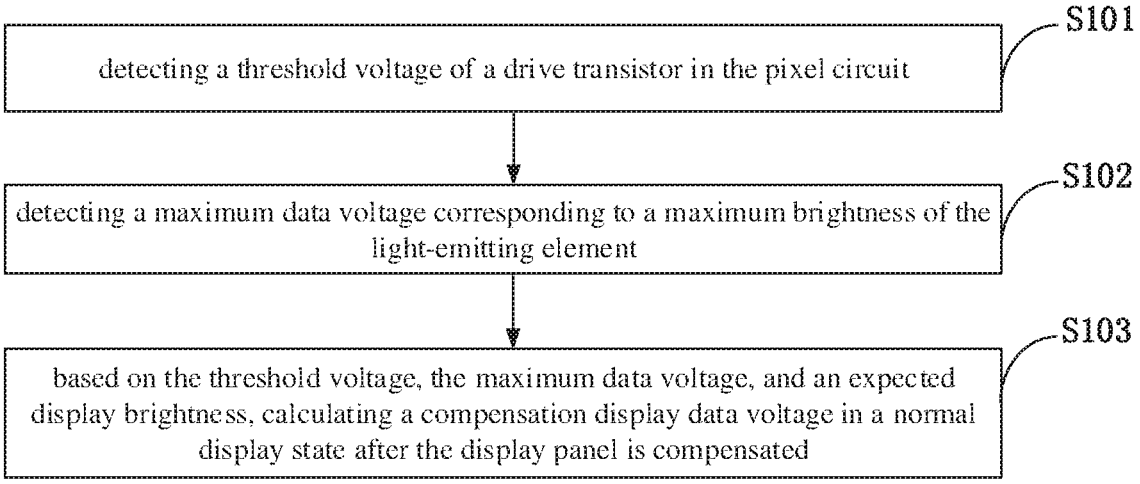
FIG. 2 is a schematic flowchart of a compensation method for a display panel according to an embodiment of the present disclosure.

An embodiment of the present disclosure provides a compensation method for a display panel. FIG. 1 is a schematic structural diagram of a pixel circuit according to an embodiment of the present disclosure; FIG. 2 is a schematic flowchart of a compensation method for a display panel according to an embodiment of the present disclosure.

For example, the display panel comprises a plurality of pixel units, as shown in FIG. 1, each pixel unit comprises a pixel circuit and a light-emitting element EL. For example, as shown in FIG. 2, the compensation method may comprise:

S101: detecting a threshold voltage of a drive transistor in a pixel circuit;

S102: detecting a maximum data voltage corresponding to a maximum brightness of the light-emitting element;

S103: based on the threshold voltage, the maximum data voltage, and an expected display brightness, calculating a compensation display data voltage in a normal display state after the display panel which is compensated.

In the compensation method provided by the embodiment of the present disclosure, by directly detecting the threshold voltage and the maximum data voltage corresponding to the maximum brightness, and further determining the compensation display data voltage of the display panel based on the threshold voltage, the maximum data voltage corresponding to the maximum brightness, and the expected display brightness, the full-screen and full-grayscale compensation display of the display panel can be implemented, thereby effectively ameliorating the problem of poor compensation uniformity caused by errors in the value of the threshold voltage due to calculation, and at the same time, the problem of low grayscale loss caused by inaccurate threshold voltage can be ameliorated, and the compensation effect is improved.

It should be noted that, the step of detecting the threshold voltage and the step of detecting the maximum data voltage may be performed in any order, and may be adjusted as required in specific implementations, and the embodiments of the present disclosure are not limited thereto.

For example, the light-emitting element EL may be an organic light-emitting diode (OLED). However, the present disclosure is not limited thereto, the organic light-emitting element may also be a quantum dot light emitting diode (QLED) or the like.

The present disclosure has no limitation in this aspect.

For example, as shown in FIG. 1, the pixel circuit may comprise a data writing transistor T1, a sense transistor T2, a drive transistor T3, and a storage capacitor C. The sense transistor T2 is configured to charge the sense line Se; the drive transistor T3 is configured to drive the light-emitting element EL to emit light; the data writing transistor T1 is configured to write a data voltage to a gate electrode of the drive transistor T3 in a case where the data writing transistor T1 is turned on; and the storage capacitor C is configured to store the data voltage and maintain the data voltage at the gate electrode of the drive transistor T3.

For example, as shown in FIG. 1, the pixel circuit may further comprise the sense line Se. The sense line Se is connected to a first electrode of the drive transistor T3 through the sense transistor T2. In each pixel circuit, a first electrode of the sense transistor T2 is electrically connected to the first electrode of the drive transistor T3, a second electrode of the sense transistor T2 is electrically connected to the sense line Se, and a gate electrode of the sense transistor T2 is configured to receive a second control signal S2. The first electrode of the drive transistor T3 is also electrically connected to an anode of the light-emitting element EL, a second electrode of the drive transistor T3 is electrically connected to a first power terminal VDD, and a gate electrode of the drive transistor T3 is electrically connected to a first electrode of the data writing transistor T1. A gate electrode of the data writing transistor T1 is configured to receive a first control signal S1, and a second electrode of the data writing transistor T1 is electrically connected to a data line Da to receive the data voltage. A terminal of the storage capacitor C is electrically connected to the first electrode of the drive transistor T3, and the other terminal of the storage capacitor C is electrically connected to the gate electrode of the drive transistor T3. A cathode of the light-emitting element EL is electrically connected to a second power terminal, and the second power terminal, for example, is grounded.

For example, the data writing transistor T1, the sense transistor T2, and the drive transistor T3 may all be thin film transistors, or field effect transistors, or other switching devices having the same characteristics. The thin film transistors may comprise polysilicon (low temperature polysilicon or high temperature polysilicon) thin film transistors, amorphous silicon thin film transistors, oxide thin film transistors, organic thin film transistors, or the like.

For example, the transistors may be classified into N-type transistors and P-type transistors according to the characteristics of the transistors. For clarity, the embodiments of the present disclosure illustrate the technical solution of the present disclosure in detail by taking a case where the data writing transistor T1, the sense transistor T2, and the drive transistor T3 are all N-type transistors (such as, N-type MOS transistors) as an example. However, the embodiments of the present disclosure are not limited thereto, and those skilled in the art may also particularly set the types of the transistors according to actual requirements. In the embodiments of the present disclosure, in order to distinguish two electrodes of the transistor besides a gate electrode of the transistor as a control electrode, one of the two electrodes is directly described as a first electrode, and the other of the two electrodes is described as a second electrode. Therefore, the first electrode and the second electrode of all or part of the transistors in the embodiments of the present disclosure are interchangeable as required.

It should be noted that, the embodiment of the present disclosure is described by taking a case where a pixel circuit adopts a 3T1C structure as an example, but the pixel circuit in the embodiment of the present disclosure is not limited to the 3T1C structure. For example, the pixel circuit may further comprise a transfer transistor, a detection transistor, reset transistor, and the like as required.

Figure 3:
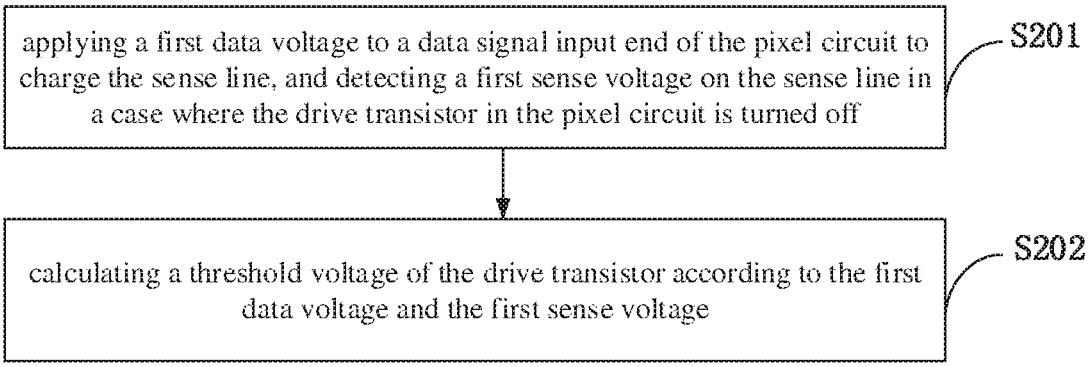
FIG. 3 is a schematic flowchart of a method for detecting a threshold voltage according to an embodiment of the present disclosure.

FIG. 3 is a schematic flowchart of a method for detecting a threshold voltage according to an embodiment of the present disclosure. For example, as shown in FIG. 3, the step S101 shown in FIG. 2 may comprise:

S201: applying a first data voltage to a data signal input end of the pixel circuit to charge the sense line, and detecting a first sense voltage on the sense line in a case where the drive transistor in the pixel circuit is turned off;

S202: calculating a threshold voltage of the drive transistor according to the first data voltage and the first sense voltage.

For example, the data signal input end of the pixel circuit can be the second electrode of the data writing transistor T1.

For example, in the step S101, the detection may be performed by taking a row of pixels as an unit in the order of progressive scanning to obtain the threshold voltages of the drive transistors T3.

Figure 4:
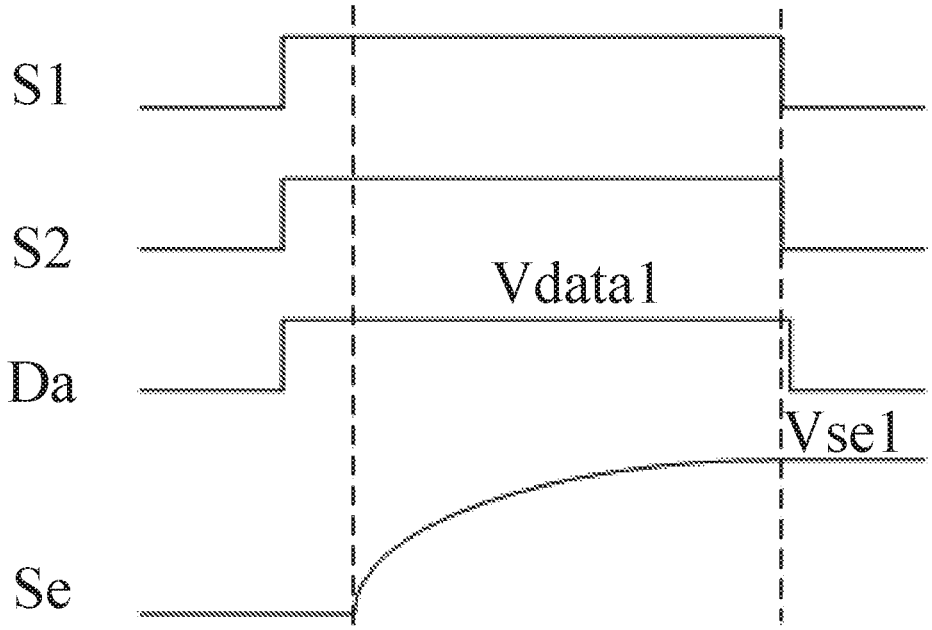
FIG. 4 is an operation timing diagram of a pixel circuit in detecting a threshold voltage according to an embodiment of the present disclosure.

FIG. 4 is an operation timing diagram of a pixel circuit in detecting a threshold voltage Vth of a drive transistor T3 according to an embodiment of the present disclosure. For example, as shown in FIG. 1 and FIG. 4, the first control signal S1 controls the turning on of the data writing transistor T1 to, and the second control signal S2 controls the turning on of the sense transistor T2, a first data voltage Vdata1 is applied to the data line Da, and the first data voltage Vdata1 is transmitted to the gate electrode of the drive transistor T3 through the data writing transistor T1, thereby controlling the turning on of the drive transistor T3. Then, the first data voltage Vdata1 charges the sense line Se sequentially through the data writing transistor T1, the drive transistor T3, and the sense transistor T2, and charges the sense line Se for a period of time until the drive transistor T3 is turned off. That is, data loading is performed on the data signal input end of the pixel circuit to charge the sense line Se until the drive transistor T3 in the pixel circuit is turned off; in a case where the drive transistor T3 is turned off, a first sense voltage Vse1 on the sense line Se is detected. A difference between the first data voltage Vdata1 on the data line Da and the first sense voltage Vse1 on the sense line Se is the threshold voltage Vth of the drive transistor T3, that is, the threshold voltage Vth=Vdata1−Vse1.

For example, during the detection process of step S101, the first data voltage Vdata1 is fixed.

Figure 5:
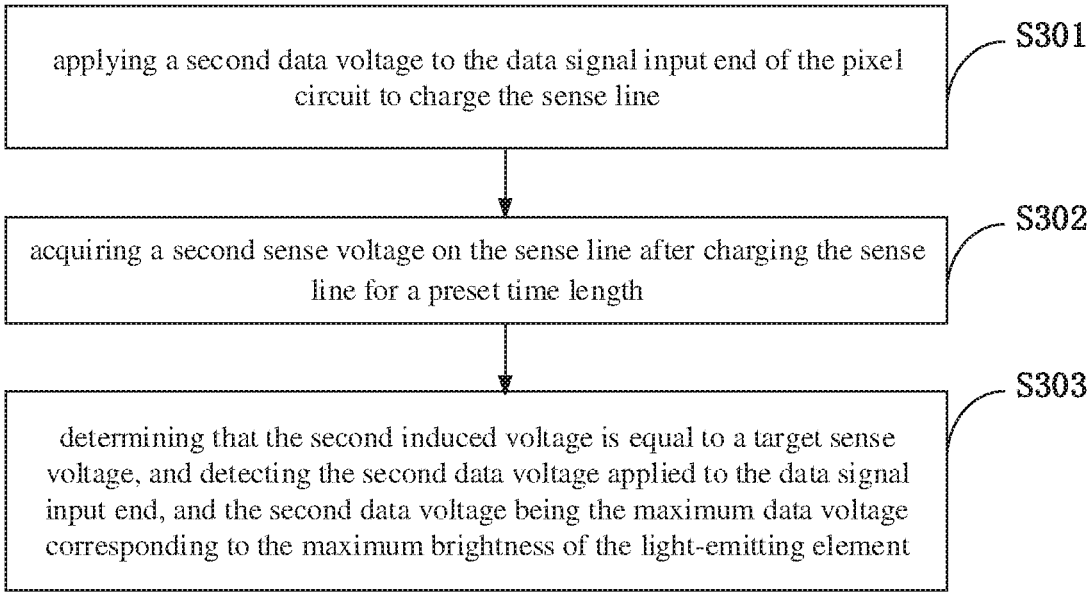
FIG. 5 is a schematic flowchart of a method for detecting a maximum data voltage corresponding to a maximum brightness of a light-emitting element according to an embodiment of the present disclosure.

FIG. 5 is a schematic flowchart of a method for detecting a maximum data voltage corresponding to a maximum brightness of a light-emitting element according to an embodiment of the present disclosure. For example, in step S102, the full screen of the display panel can be charged and detected, and in a case where a second sense voltage on the sense line of each pixel unit is equal to a target sense voltage, a second data voltage applied to the data signal input end of each pixel circuit is a maximum data voltage corresponding to a maximum brightness of each light-emitting element.

For example, as shown in FIG. 5, the step S102 shown in FIG. 2 may comprise:

S301: applying a second data voltage to the data signal input end of the pixel circuit to charge the sense line;

S302: acquiring a second sense voltage on the sense line after charging the sense line for a preset time length; and S303: determining that the second sense voltage is equal to a target sense voltage, and detecting the second data voltage applied to the data signal input end, and the second data voltage being the maximum data voltage corresponding to the maximum brightness of the light-emitting element.

For example, in step S303, processes of charging and detecting in step S302 and S301 can be performed on all pixel units on the display panel at least once.

For example, the step S302 may comprise: detecting the second sense voltage on the sense line after charging the sense line for the preset time length; comparing the second sense voltage with the target sense voltage; in response to determining that the second sense voltage is larger than the target sense voltage, reducing the second data voltage applied to the data signal input end; in response to determining that the second sense voltage is smaller than the target sense voltage, increasing the second data voltage applied to the data signal input end; and in response to determining that the second sense voltage is equal to the target sense voltage, acquiring the second sense voltage on the sense line.

For example, in step S302, the preset time length can be 400-500 microseconds. However, the present disclosure is not limited thereto, and the preset time length can be particularly set according to actual requirements.

Figure 6A:
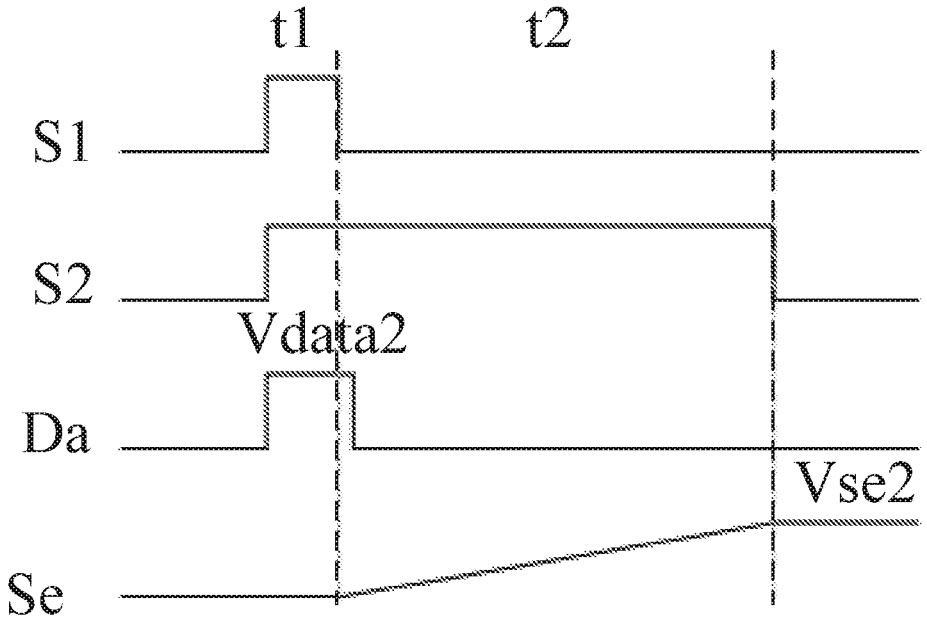
FIGS. 6*a* and 6*b* are respectively operation timing diagrams of a pixel circuit in detecting a maximum data voltage corresponding to a maximum brightness of a light-emitting element according to an embodiment of the present disclosure.
Figure 6B:
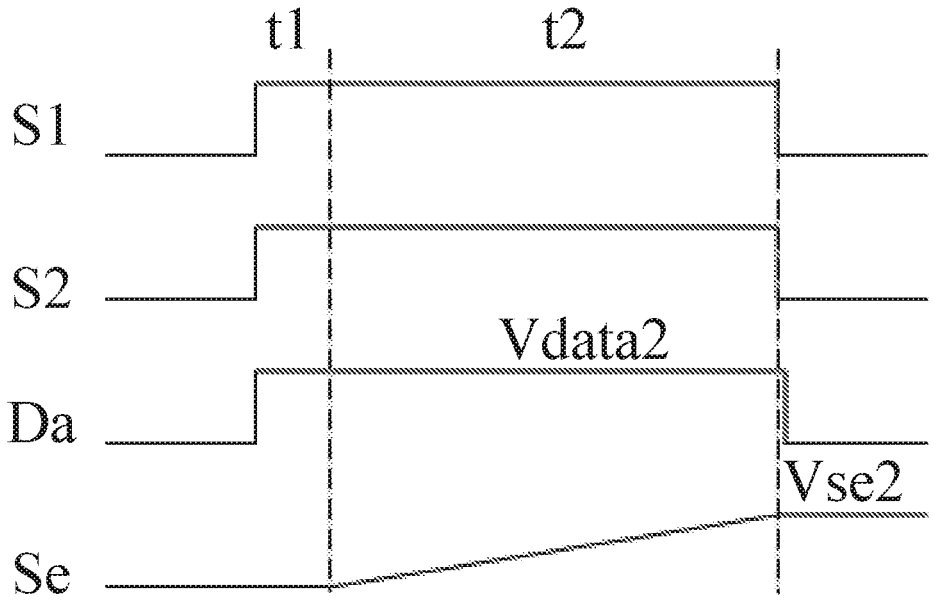

FIGS. 6*a* and 6*b* are respectively operation timing diagrams of a pixel circuit in detecting a maximum data voltage Vgs1 corresponding to a maximum brightness of a light-emitting element.

For example, as shown in FIG. 1 and FIG. 6*a*, in an example, in a t1 phase, the data writing transistor T1 can be controlled to be turned on by the first control signal S1, and the sense transistor T2 can be controlled to be turned on by the second control signal S2, the second data voltage Vdata2 is applied to the data line Da (the second data voltage Vdata2 shown in FIG. 6*a* and FIG. 6*b* can be adjusted according to actual requirements, that is, the step S301 is performed multiple times), the second data voltage Vdata2 is transmitted to the gate electrode of the drive transistor T3 through the data writing transistor T1, thereby controlling the drive transistor T3 to be turned on, in this case, a voltage of the gate electrode of the drive transistor T3 is the second data voltage Vdata2. In a t2 phase, the data writing transistor T1 is controlled to be turned off by the first control signal S1, and the sense transistor T2 is controlled to be turned on by the second control signal S2. Because a current still flows through the drive transistor T3 and the sense transistor T2 to charge the sense line Se during the t2 phase, a voltage of the first electrode of the drive transistor T3 continues to rise, and thus a voltage of the gate electrode of the drive transistor T3 also rises. After the preset time length, the voltage of the first electrode of the drive transistor T3 is detected, and at this dine, the voltage of the first electrode of the drive transistor T3 is the second sense voltage Vse2 on the sense line Se, and the voltage of the gate electrode of the drive transistor T3 is a sum of the second data voltage Vdata2 and the second sense voltage Vse2.

For example, in an example shown in FIG. 6*b*, a working principle of the example shown in FIG. 6*b* is substantially the same as that of the example shown in FIG. 6*a* with the difference in that in the t2 phase, the data writing transistor T1 is controlled to be turned on by the first control signal S1, that is, in the t2 phase, the data writing transistor T1 is in a turn-on state. Because the data writing transistor T1 is turned on, after charging the sense line Se for the preset time length, the voltage of the first electrode of the drive transistor T3 is the second sense voltage Vse2 on the sense line Se, and the voltage of the gate electrode of the drive transistor T3 is the second data voltage Vdata2.

It should be noted that in the example shown in FIG. 6*a*, the second sense voltage Vse2 linearly increases within the preset time length, and in the example shown in FIG. 6*b*, the second sense voltage Vse2 increases non-linearly within the preset time length.

For example, in practical applications, the target sense voltage (Target) can be measured in advance. The target sense voltage can be measured by performing a local lighting test on the display panel, namely by sampling and detecting the brightness of a local area on the display panel. For example, the compensation method provided by the embodiments of the present disclosure may further comprise: selecting a local area of the display panel, applying a maximum local data voltage to the local area to charge the sense line; and after charging the sense line for a preset time length, detecting a voltage on the sense line. The voltage on the sense line is the target sense voltage.

For example, the maximum local data voltage may indicate a data voltage corresponding to the maximum brightness of a light-emitting element in the local area. The maximum local data voltage can be measured in advance, that is, a data voltage is applied to the local area, and the data voltage is continuously adjusted so that the brightness of the local area reaches the maximum brightness, and in this case, the applied data voltage is the maximum local data voltage. For example, the maximum brightness can be preset according to the actual application requirements.

For example, the local area may be a central area of the display panel. A size of the local area may be determined according to actual application requirements, and the present disclosure has no limitation this aspect.

As shown in FIG. 1, in a case where the sense line Se is charged for a specific time length so that the second sense voltage Vse2 on the sense line: Se reaches the target sense voltage, it is considered that the light-emitting element EL reaches the maximum brightness. If the second sense voltage Vse2 is higher than the target sense voltage, the second sense voltage Vse2 applied to the data line Da is reduced; if the second sense voltage Vse2 is lower than the target sense voltage, the second sense voltage Vse2 applied to the data line Da is increased, and the above described method is cycled many times until the second sense voltages Vse2 on the sense lines Se of the full screen are equal to the target sense voltage. In this case, the second data voltages Vdata2 applied to the data signal input ends of respective pixel circuits are the maximum data voltages Vgs1 corresponding to the maximum brightness of individual light-emitting elements, and the full screen can be uniformly compensated for the highest brightness.

For example, in step S103, the compensation display data voltage of the display panel is calculated according to the following calculation formula:

$$Vgs=\sqrt{L}(Vgs1-Vth)+Vth$$

where Vgs is the compensation display data voltage, Vgs1 is the maximum data voltage, L is the expected display brightness, and Vth is the threshold voltage of the drive transistor T3.

For example, in step S103, the expected display brightness can be determined based on a current data voltage. For example, according to a correspondence between a data voltage and a gray scale, the expected display brightness of the display panel can be calculated by a formula.

For example, the expected display brightness L is normalized brightness, i.e., the maximum display brightness corresponding to the maximum data voltage is 1. In the normal display state, the correspondence between the applied data voltage and the expected display brightness L can be obtained by gamma conversion.

For example, in a case where the light-emitting element EL emits light with a maximum brightness, a maximum data voltage corresponding to the maximum brightness is Vgs1, and in this case, a maximum brightness current Imax corresponding to the maximum data voltage Vgs1 can be expressed as:

$$I\max=K(Vgs1-Vth)^2 \quad (1)$$

where K is a constant related to process parameters and geometric dimensions of the drive transistor T3.

The formula (1) can be deformed as:

$$\sqrt{\frac{I\max}{K}}=(Vgs1-Vth) \quad (2)$$

The formula of the drive current $I=K(Vgs-Vth)^2$ in a case where the display panel displays normally can be deformed as:

$$Vgs=\sqrt{\frac{I}{K}}+Vth \quad (3)$$

Because the brightness of the light-emitting element EL is positively proportional to the light-emitting current, a relationship between a normal light-emitting current I and a maximum light-emitting current Imax is expressed as:

$$I=I_{max}\frac{L}{L_{max}} \quad (4)$$

where in the formula (4), is an expected display brightness of the light-emitting element, and Lmax is the maximum display brightness. Because the expected display brightness L and the maximum display brightness Lmax are both normalized brightness, the maximum display brightness Lmax is 1. The formulas (2) and (4) are brought into formula (3), so the compensation display data voltage after the display panel is compensated in the normal display state can be obtained as follows:

$$Vgs=\sqrt{L}(Vgs1-Vth)+Vth$$

Figure 7:
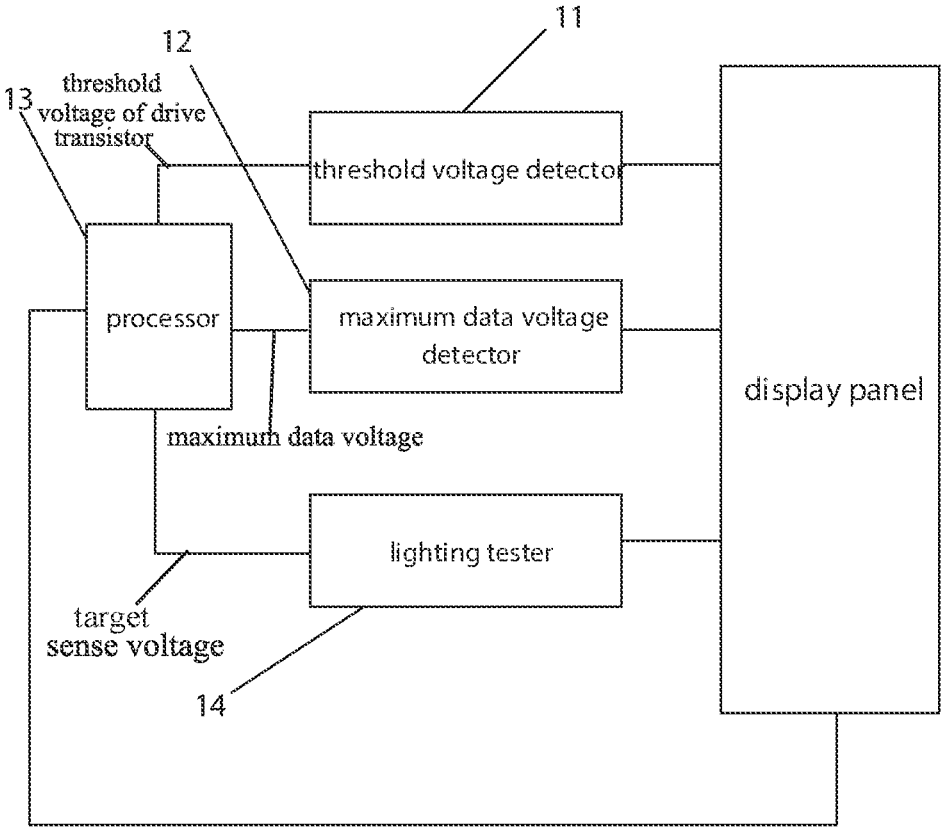
FIG. 7 is a schematic block diagram of a compensation device according to an embodiment of the present disclosure.

An embodiment of the present disclosure also provides a compensation device for a display panel. The display panel comprises a plurality of pixel units, and each pixel unit comprises a pixel circuit and a light-emitting element. FIG. 7 is a schematic block diagram of a compensation device according to an embodiment of the present disclosure. As shown in FIG. 7, the compensation device may comprise: a threshold voltage detector 11, a maximum data voltage detector 12, and a processor 13. The threshold voltage detector 11 is configured to detect a threshold voltage of a drive transistor in each pixel circuit; the maximum data voltage detector 12 is configured to detect a maximum data voltage corresponding to a maximum brightness of the light-emitting element; and the processor 13 is configured, based on the threshold voltage, the maximum data voltage and an expected display brightness, to calculate a compensation display data voltage in a normal display state after the display panel is compensated.

The above compensation device provided by the embodiment of the present disclosure can directly detect the threshold voltage Vth of the drive transistor and the maximum data voltage Vgs1 in the pixel circuit through the threshold voltage detector and the maximum data voltage detector, and then perform calculation based on the threshold voltage, the maximum data voltage, and the expected display brightness by the processor to obtain the compensated compensation display data voltage, thereby achieving the full-screen and full-grayscale compensation display of the display panel, effectively ameliorating the problem of poor compensation uniformity caused by errors in the threshold voltage which are introduced by calculation, and at the same time, the problem of low grayscale loss caused by inaccurate threshold voltage can be ameliorated, and the compensation effect is improved.

It should be noted that a specific description of the pixel circuit can refer to the related description in the embodiment of the above compensation method, and the repeated portions are not described again.

For example, the threshold voltage detector 11 is configured to: apply a first data voltage to a data signal input end of the pixel circuit to charge the sense line, and detect a first sense voltage on the sense line in a case where the drive transistor in the pixel circuit is turned off; and calculate the threshold voltage of the drive transistor according to the first data voltage and the first sense voltage.

For example, the threshold voltage may be obtained by a following calculation formula: Vth=Vdata1−Vse1, where Vth is the threshold voltage of the drive transistor, Vdata1 is the first data voltage, and Vse1 is the first sense voltage.

For example, the maximum data voltage detector 12 is configured to: apply a second data voltage to a data signal input end of each pixel circuit to charge the sense line; acquire a second sense voltage on the sense line after charging the sense line for a preset time length; and determine that the second sense voltage is equal to a target sense voltage, and detect the second data voltage applied to the data signal input end, which is the maximum data voltage corresponding to the maximum brightness of the light-emitting element.

For example, in the above compensation device provided by the embodiment of the present disclosure, the full screen can be charged and detected by the maximum data voltage detector 12, that is, the processes of charging and detecting can be performed on all pixel units on the display panel at least once. For example, an operation of acquiring the second sense voltage on the sense line after charging the sense line for the preset time length may comprise: detecting the second sense voltage on the sense line after charging the sense line for the preset time length; comparing the second sense voltage with the target sense voltage; in response to determining that the second sense voltage is larger than the target sense voltage, reducing the second data voltage applied to the data signal input end; in response to determining that the second sense voltage is smaller than the target sense voltage, increasing the second data voltage applied to the data signal input end; and in response to determining that the second sense voltage is equal to the target sense voltage, acquiring the second sense voltage on the sense line.

For example, in a case where the second sense voltage on the sense line of each pixel unit is equal to the target sense voltage, the second data voltages applied to the data signal input ends of respective pixel circuits are the maximum data voltages corresponding to the maximum brightness of individual light-emitting elements.

For example, practical applications, the target sense voltage (Target) can be measured first, and the target sense voltage can be measured by performing local lighting test on the display panel.

For example, as shown in FIG. 7, the compensation device provided by the embodiment of the present disclosure may further comprise a lighting tester 14. The lighting tester 14 is configured to perform a local lighting test on the display panel to determine the target sense voltage. That is, the lighting tester 14 may be used to apply a maximum local data voltage to a selected local area to charge the sense line; and after charging the sense line for a preset time length, detect a voltage on the sense line. The voltage on the sense line is the target sense voltage.

For example, the local area may be a central area of the display panel. A size of the local area may be determined according to actual application requirements, and the present disclosure does not limit the size of the local area.

For example, the compensation display data voltage may be calculated according to the following calculation formula:

$$Vgs=\sqrt{L}(Vgs1-Vth)+Vth$$

where Vgs is the compensation display data voltage after the display panel is compensated for in a normal display state, Vgs1 is the maximum data voltage, L is the expected display brightness, and Vth is the threshold voltage of the drive transistor. A specific derivation process of the formulas is as described above and will not be described here again.

For example, the threshold voltage detector 11 the maximum data voltage detector 12, the processor 13, and the lighting tester 14 may be implemented by a combination of embedded software and circuit hardware.

It should be noted that specific working processes of the threshold voltage detector 11, the maximum data voltage detector 12, the processor 13, and the lighting tester 14 may refer to the relevant descriptions of the embodiments of the above compensation method for the display panel, and the repeated descriptions are not described here again.

Figure 8:
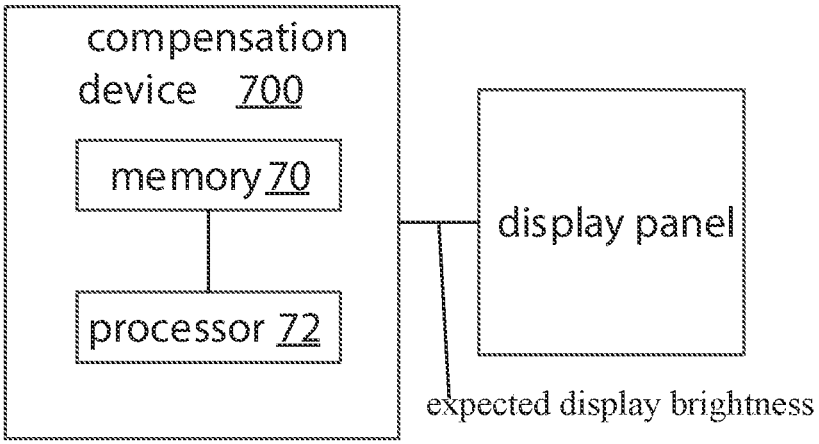
FIG. 8 is a schematic block diagram of another compensation device according to an embodiment of the present disclosure.

An embodiment of the present disclosure also provides a compensation device for a display panel. FIG. 8 is a schematic block diagram of another compensation device for a display panel according to an embodiment of the present disclosure. As shown in FIG. 8, the compensation device 700 may comprise a memory 70 and a processor 72. The compensation device 700 may be configured to perform brightness compensation on the display panel.

For example, the memory 70 is configured to store non-transitory computer readable instructions. The processor 72 is configured to execute the non-transitory computer readable instructions, in a case where the non-transitory computer readable instructions are executed by the processor 72, one or more steps in the compensation method described in any one of the above embodiments may be performed.

For example, the memory 70 and the processor 72 may be interconnected by a bus system and/or other forms of connection mechanism (not shown).

For example, the processor 72 may provide the first control signal S1, the second control signal S2, the first data voltage Vdata1, the second data voltage Vdata2, and the like to the pixel circuit in a case where the processor 72 executes the non-transitory computer readable instructions. The processor 72 may perform operations such as detecting a sense voltage on the sense line Se and the like in a case where the processor 72 executes the non-transitory computer readable instructions.

For example, the processor 72 may be a central processing unit (CPU) or other forms of processing units having data processing capabilities and/or program execution capabilities, such as a field-programmable gate array (FPGA), or a tensor processing unit (TPU), or the like. For example, the central processing unit (CPU) may adopt an X86, ARM architecture, or the like.

For example, the memory 70 may comprise an arbitrary combination of one or more computer program products. The computer program products may comprise various forms of computer-readable storage media, such as volatile memory and/or non-volatile memory. The volatile memory may comprise, for example, a random access memory (RAM) and/or a cache or the like. The non-volatile memory may comprise, for example, a read only memory (ROM), a hard disk, an erasable programmable read only memory (EPROM), a portable compact disc-read only memory (CD-ROM), a USB memory, a flash memory, and the like. One or more computer programs may be stored on the computer-readable storage medium and the processor 72 may execute the non-transitory computer-readable instructions to implement various functions of the compensation device 700. Various applications, various data, various data used and/or generated by the applications, and the like, may also be stored in the computer-readable storage medium.

For example, the memory 70 and the processor 72 may be integrated in a single chip.

Figure 9:
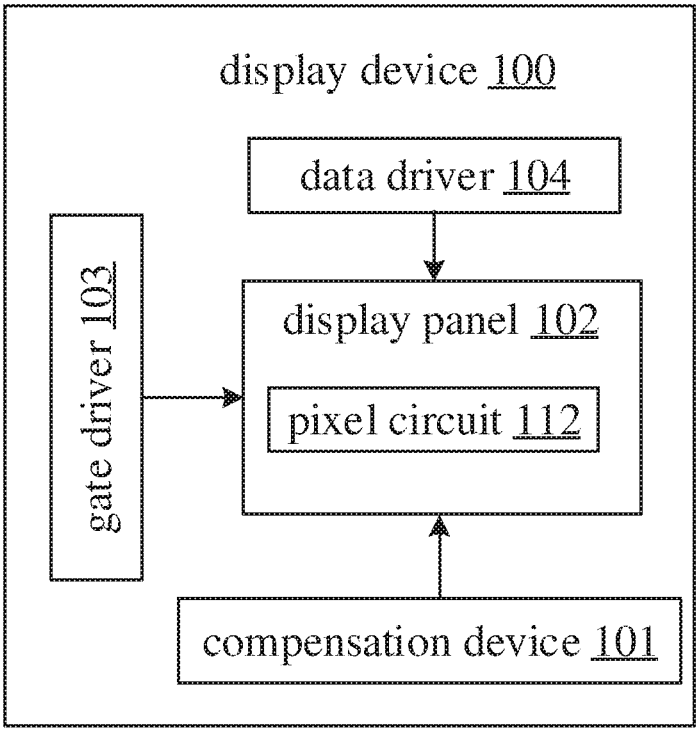
FIG. 9 is a schematic block diagram of a display device according to an embodiment of the present disclosure.

An embodiment of the present disclosure also provides a display device. FIG. 9 is a schematic block diagram of a display device according to an embodiment of the present disclosure. As shown in FIG. 9, the display device 100 may comprise the compensation device 101 provided by any one of the embodiments of the present disclosure.

It should be noted that a relevant description of the compensation device 101 may refer to the description of the embodiment of the above compensation device, details of which are not repeated here.

For example, as shown in FIG. 9, the display device 100 further comprises a display panel 102, a gate driver 103, and a data driver 104. The display panel 102 is used for displaying an image, and the display panel 102 may comprise a pixel circuit 112. The gate driver 103 is configured to provide control signals (such as, a first control signal and a second control signal) to the pixel circuit 112, thereby controlling the drive transistor and the sense transistor to be turned on or off. The data driver 104 is configured to provide data voltages (such as, a first data voltage and a second data voltage) to the pixel circuit 112 through data lines.

For example, the display device 100 may be a mobile phone, a tablet computer, a television, a monitor, a notebook computer, a digital photo frame, a navigator, or any products or components having a display function.

It should be noted that other necessary components (such as, a control device, an image data encoding/decoding device, a row scan driver, a column scan driver, a clock circuit and the like) of the display device 100 should be included as understood by one of ordinary skill in the art, which will be omitted here, and should not be taken as limitations on the embodiments of the present disclosure The embodiments of the present disclosure provide a compensation method for a display panel, a compensation device for a display panel, and a display device. The display panel comprises a plurality of pixel units, and each pixel unit comprises a pixel circuit and a light-emitting element. The compensation method comprises: detecting a threshold voltage of a drive transistor in the pixel circuit; detecting a maximum data voltage corresponding to a maximum brightness of the light-emitting element; and based on the threshold voltage, the maximum data voltage, and an expected display brightness, calculating a compensation display data voltage in a normal display state after the display panel is compensated. In the compensation method, by directly detecting the threshold voltage and the maximum data voltage, and further determining the compensation display data voltage of the display panel through the threshold voltage, the maximum data voltage corresponding to the maximum brightness and the expected display brightness, the full-screen and full-grayscale compensation display of the display panel can be implemented, thereby effectively ameliorating the problem of poor compensation uniformity caused by errors of the value of the threshold voltage which are introduced by calculation, and at the same time, the problem of low grayscale loss caused by inaccurate threshold voltage can be ameliorated, and the compensation effect is improved.

Obviously, various modifications and variations can be made by those skilled in the art to the present disclosure, without departing from the spirits and the scope of the present disclosure. Therefore, so far as these variations and modifications fall in the scope of the claims and their equivalents of the present disclosure, the present disclosure shall also intend to cover such variations and modifications.

What is claimed is:

1. A compensation method for a display panel, wherein the display panel comprises a plurality of pixel units, each pixel unit comprises a pixel circuit and a light-emitting element, and the compensation method comprises:

detecting a threshold voltage of a drive transistor in the pixel circuit;

detecting a maximum data voltage corresponding to a maximum brightness of the light-emitting element; and based on the threshold voltage, the maximum data voltage and an expected display brightness, calculating a compensation display data voltage for the display panel to achieve the expected display brightness, wherein the compensation display data voltage is calculated according to a following calculation formula:

$$Vgs=\sqrt{L}(Vgs1-Vth)+Vth$$

where Vgs represents the compensation display data voltage, Vgs1 represents the maximum data voltage, L represents the expected display brightness, and Vth represents the threshold voltage of the drive transistor.

2. The compensation method according to claim 1, wherein the pixel circuit comprises a sense line connected to a first electrode of the drive transistor, and the detecting the threshold voltage of the drive transistor in the pixel circuit comprises:

applying a first data voltage to a data signal input end of the pixel circuit to charge the sense line;

detecting a first sense voltage on the sense line in a case where the drive transistor in the pixel circuit is turned off; and calculating the threshold voltage of the drive transistor according to the first data voltage and the first sense voltage.

3. The compensation method according to claim 2, wherein the threshold voltage is obtained by a following calculation formula:

$$Vth=V\text{data}1-Vse1$$

where Vth represents the threshold voltage of the drive transistor, Vdata1 represents the first data voltage, and Vse1 represents the first sense voltage.

4. The compensation method according to claim 1, wherein the pixel circuit comprises a sense line connected to a first electrode of the drive transistor, and the detecting the maximum data voltage corresponding to the maximum brightness of the light-emitting element comprises:

applying a second data voltage to a data signal input end of the pixel circuit to charge the sense line;

acquiring a second sense voltage on the sense line after charging the sense line for a preset time length; and detecting the second data voltage applied to the data signal input end and using the detected second data voltage applied to the data signal end as the maximum data voltage corresponding to the maximum brightness of the light-emitting element, in response to determining that the second sense voltage is equal to a target sense voltage.

5. The compensation method according to claim 4, wherein the acquiring the second sense voltage on the sense line after charging the sense line for the preset time length comprises:

detecting the second sense voltage on the sense line after charging the sense line for the preset time length;

comparing the second sense voltage with the target sense voltage;

reducing the second data voltage applied to the data signal input end, in response to determining that the second sense voltage is greater than the target sense voltage;

increasing the second data voltage applied to the data signal input end, in response to determining that the second sense voltage is smaller than the target sense voltage; and acquiring the second sense voltage on the sense line, in response to determining that the second sense voltage is equal to the target sense voltage.

6. The compensation method according to claim 4, further comprising:

performing a local lighting test on the display panel to determine the target sense voltage.

7. A compensation device for a display panel, comprising:

a memory, configured to store non-transitory computer readable instructions; and a processor, configured to execute the non-transitory computer readable instructions, wherein in a case where the non-transitory computer readable instructions are executed by the processor, the compensation method according to claim 1 is performed.

8. A display device, comprising the compensation device according to claim 7.

9. A compensation device for a display panel, wherein the display panel comprises a plurality of pixel units, each pixel unit comprises a pixel circuit and a light-emitting element, and the compensation device comprises a threshold voltage detector, a maximum data voltage detector, and a processor, the threshold voltage detector is configured to detect a threshold voltage of a drive transistor in the pixel circuit;

the maximum data voltage detector is configured to detect a maximum data voltage corresponding to a maximum brightness of the light-emitting element; and the processor is configured, based on the threshold voltage, the maximum data voltage, and an expected display brightness, to calculate a compensation display data voltage for the display panel to achieve the expected display brightness, wherein the compensation display data voltage is calculated according to a following calculation formula:

$$Vgs=\sqrt{L}(Vgs1-Vth)+Vth$$

where Vgs represents the compensation display data voltage, Vgs1 represents the maximum data voltage, L represents the expected display brightness, and Vth represents the threshold voltage of the drive transistor.

10. The compensation device according to claim 9, wherein the pixel circuit comprises a sense line connected to a first electrode of the drive transistor, and the threshold voltage detector is configured to:

apply a first data voltage to a data signal input end of the pixel circuit to charge the sense line;

detect a first sense voltage on the sense line in a case where the drive transistor in the pixel circuit is turned off; and calculate the threshold voltage of the drive transistor according to the first data voltage and the first sense voltage.

11. The compensation device according to claim 10, wherein the threshold voltage is obtained by a following calculation formula:

$$Vth=V\text{data}1-Vse1$$

where Vth represents the threshold voltage of the drive transistor, Vdata1 represents the first data voltage, and Vse1 represents the first sense voltage.

12. The compensation device according to claim 10, wherein the pixel circuit further comprises a data writing transistor, a sense transistor, and a storage capacitor, the drive transistor is configured to drive the light-emitting element to emit light;

the data writing transistor is configured to write a data voltage to a gate electrode of the drive transistor in a case where the data writing transistor is turned on;

the storage capacitor is configured to store the data voltage and maintain the data voltage at the gate electrode of the drive transistor; and the sense transistor is configured to charge the sense line.

13. The compensation device according to claim 12, wherein a first electrode of the sense transistor is electrically connected to a first electrode of the drive transistor, a second electrode of the sense transistor is electrically connected to the sense line, and a gate electrode of the sense transistor is configured to receive a second control signal;

the first electrode of the drive transistor is further electrically connected to an anode of the light-emitting element, a second electrode of the drive transistor is electrically connected to a first power terminal, and the gate electrode of the drive transistor is electrically connected to a first electrode of the data writing transistor;

a gate electrode of the data writing transistor is configured to receive a first control signal, and a second electrode of the data writing transistor is configured to receive the data voltage; and a terminal of the storage capacitor is electrically connected to the first electrode of the drive transistor, and a remaining terminal of the storage capacitor is electrically connected to the gate electrode of the drive transistor.

14. The compensation device according to claim 9, wherein the pixel circuit comprises a sense line connected to a first electrode of the drive transistor, and the maximum data voltage detector is configured to:

apply a second data voltage to a data signal input end of the pixel circuit to charge the sense line;

acquire a second sense voltage on the sense line after charging the sense line for a preset time length; and detect the second data voltage applied to the data signal input end and use the detected second data voltage applied to the data signal input end as the maximum data voltage corresponding to the maximum brightness of the light-emitting element, in response to determining that the second sense voltage is equal to a target sense voltage.

15. The compensation device according to claim 14, wherein an operation of acquiring the second sense voltage on the sense line after charging the sense line for the preset time length comprises:

detecting the second sense voltage on the sense line after charging the sense line for the preset time length;

comparing the second sense voltage with the target sense voltage;

reducing the second data voltage applied to the data signal input end, in response to determining that the second sense voltage is greater than the target sense voltage;

increasing the second data voltage applied to the data signal input end, in response to determining that the second sense voltage is smaller than the target sense voltage; and acquiring the second sense voltage on the sense line, in response to determining that the second sense voltage is equal to the target sense voltage.

16. The compensation device according to claim 14, further comprising: a lighting tester, wherein the lighting tester is configured to perform a local lighting test on the display panel to determine the target sense voltage.

17. A display device, comprising the compensation device according to claim 9.

* * * * *